United States Patent [19]

Hosoi et al.

[11] Patent Number: 4,576,831

[45] Date of Patent: Mar. 18, 1986

[54] PROCESS FOR PRODUCING HEAT-SENSITIVE RECORDING PAPER

[75] Inventors: Noriyuki Hosoi; Kensuke Ikeda; Hiroharu Matsukawa, all of Shizuoka, Japan

[73] Assignee: Fuji Photo Film Co., Ltd., Kanagawa, Japan

[21] Appl. No.: 525,773

[22] Filed: Aug. 23, 1983

[30] Foreign Application Priority Data

Aug. 23, 1982 [JP] Japan ..... 57-145872

[51] Int. Cl.[4] ..... B41M 5/18

[52] U.S. Cl. ..... 427/40; 346/200; 427/150; 427/151; 428/537.5; 428/913

[58] Field of Search ..... 282/27.5; 346/135.1, 346/200, 226; 427/40, 150–153; 428/320.4–320.8, 411, 488, 537, 913, 914, 411.1, 488.1, 537.5

[56] References Cited

U.S. PATENT DOCUMENTS 3,924,041 12/1975 Miyayama et al. ..... 428/913

*Primary Examiner*—Bruce H. Hess

*Attorney, Agent, or Firm*—Sughrue, Mion, Zinn, Macpeak and Seas

[57] ABSTRACT

A process for producing a heat-sensitive recording paper is disclosed. The process involves pretreating base paper by a high-frequency corona discharge. The base paper treated in this manner can be utilized in producing a heat-sensitive recording material by providing a heat-sensitive layer thereon. By subjecting the base paper to the high-frequency corona discharge treatment the base paper can be uniformly coated with a heat-sensitive recording material without leaving any blank spaces thereon.

3 Claims, No Drawings

PROCESS FOR PRODUCING HEAT-SENSITIVE RECORDING PAPER

FIELD OF THE INVENTION

The present invention relates to a process for producing heat-sensitive recording paper. In greater detail, it relates to a process for producing heat-sensitive recording paper having an excellent coating surface.

BACKGROUND OF THE INVENTION

Heat-sensitive recording paper can produce an image due to a physical or chemical change of substances caused by thermal energy. A number of different types of recording paper for forming images have been studied.

In recent years there has been development of facsimiles and printers. In particular there has been a notable development of such devices utilizing a combination of a heat-sensitive recording paper prepared by applying a coating solution for forming a heat-sensitive recording layer containing a colorless dye such as Crystal Violet lactone, etc. and a phenolic compound as described in Japanese Patent Publication No. 14039/70 (U.S. Pat. No. 3,539,375) and a thermal head has been widely adopted for these apparatus. Such a process is referred to as a thermographic process.

This thermographic process has many advantages in that the recording paper need not carry out development because of first order color formation, the recording apparatus can be simplified, the cost of the recording paper and the recording apparatus is low, and noise does not appear because of non-impact recording. Therefore, it has been popularly used in recent years.

However, when a coating solution for forming a heat-sensitive recording layer is applied to paper, fine parts having a diameter of 0.5 mm or less which are not coated with the coating solution are formed on the surface of coated paper. Consequently, when typing is carried out by a thermal head utilized in devices such as a facsimile, there is no color formation on such parts, resulting in obscure recording.

SUMMARY OF THE INVENTION

It is therefore one object of the present invention to provide a process for producing heat-sensitive recording paper having an excellent coating surface, by which the entire surface is uniformly coated with a heat-sensitive recording layer.

Another object of the present invention is to provide a process for producing heat-sensitive recording paper having an excellent image forming ability without thinning.

The objects of the present invention have been attained by a process for producing heat-sensitive recording paper which comprises pretreating base paper with high-frequency corona discharge and then applying a coating solution for forming a heat-sensitive recording layer to the base paper.

DETAILED DESCRIPTION OF THE INVENTION

In the present invention, the method of corona discharge treatment is not particularly restricted. For example, the corona discharge treatment is carried out according to methods described in German Pat. No. 2,010,478, Japanese Patent Publication No. 12082/71, and U.S. Pat. Nos. 3,837,886 and 4,055,685. In high-frequency corona discharge treatment, an electrode such as aluminium-knife type electrode, a dielectric roll such as stainless steel roll coated with hypalon rubber (e.g., 3.2 mm) and an oscillator such as oscillation device comprising vacuum tube and transistor are usually used.

When carrying out the corona discharge treatment, the discharge frequency, discharge voltage and discharge electric current are not particularly restricted. However, preferable results are obtained when applying higher energy.

The discharge frequency used is generally in the range of 5 to 200 KHz, preferably 5 to 100 KHz. Further, intensity of the applied energy varies according to the kind of solution or the kind of paper, but suitable results are obtained when the product of the discharge electric current and the discharge voltage applied to a unit width is in a range of 0.5 $KVA/m^2$ to 50 $KVA/m^2$, preferably 2 to 30 $KVA/m^2$.

Further, the rate of corona discharge treatment is not subject to any restriction. However, the higher the rate of treatment is, the higher applied energy must be. Generally, the treatment is carried out at a rate of 30 m/min to 1,000 m/min, preferably 50 to 500 m/min.

The base paper used in the present invention may be high-grade paper, middle-grade paper, regenerated paper, coat paper and others. Further, synthetic paper can be used. The high-grade papers having a weight of 30 $g/m^2$ to 300 $g/m^2$ and a permeability of 20 to 200 seconds (measured by the J. TAPPI Test Method No. 5 by means of an air-micro type tester for permeability) are preferably used.

The coating solution for forming the heat-sensitive layer in the present invention is prepared by finely dispersing heat-sensitive color forming materials in water as a dispersion medium. For example, there are dispersions wherein an electron donating colorless dye such as Crystal Violet lactone and an electron accepting compound such as 2,2-bis-(4-hydroxyphenyl)propane are dispersed as fine particles having a particle size of several microns or less in an aqueous solution of polyvinyl alcohol. Processes for preparing such coating solutions have been described in, for example, U.S. Pats. Nos. 3,539,375 and 4,255,491, and Japanese Patent Application (OPI) 93492/80 (The term "OPI" as used herein refers to a "published unexamined Japanese patent application".). It is preferred that dispersion particles contained in the heat-sensitive coating solution have a volume average particle size of 8 μm or less and, preferably, 4 μm or less, because the effective area of contacting with the thermal head is reduced if coarse particles are present. The volume average particle size is determined by the following relationships:

$$\frac{4}{3}\pi\left(\frac{\phi}{2}\right)^3 = \left(\frac{\text{The total volume of particles}}{\text{The total number of particles}}\right)$$

$$\phi = \left(\frac{6}{\pi} \times \frac{\text{The total volume of particles}}{\text{The total number of particles}}\right)^{\frac{1}{3}}$$

The electron donating colorless dye (color former) used in the heat-sensitive coating solution in the present invention is not restricted. Useful dyes include those used for conventional pressure-sensitive recording papers and heat-sensitive recording papers. Examples of useful dyes include (1) triarylmethane compounds such as 3,3-bis-(p-dimethylaminophenyl)-6-dimethylaminophthalide (Crystal Violet lactone), 3,3-bis-(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis-(1,2-dimethylindol-3-yl)-5-dimethylaminophthalide, 3,3-bis-(1,2,-dimethylindol-3-yl)-6-di-methylaminophthalide, 3,3-bis-(9-ethylcarbazol-3-yl)-5-dimethylaminophthalide, 3,3-bis-(2-phenylindol-3-yl)-5-dimethylaminophthalide or 3-p-dimethylaminophenyl-3-(1-methylpyrrol-2-yl)-6-dimethylaminophthalide, etc., (2) diphenylmethane compounds such as 4,4'-bis-dimethylaminobenzohydrin benzyl ether, N-halophenyl leuco Auramine or N-2,4,5-trichlorophenyl leuco Auramine, etc., (3) xanthene compounds such as Rhodamine B-anilinolactam, Rhodamine B-p-nitroanilinolactam, Rhodamine B-p-chloroanilinolactam, 3-diethylamino-7-dibenzylaminofluoran, 3-diethylamino-7-octylaminofluoran, 3-diethylamino-7-phenylfluoran, 3-diethylamino-7-3,4-dichloroanilinofluoran, 3-diethylamino-7-(2-chloroanilino)fluoran, 3-diethylamino-6-methyl-7-anilinofluoran, 3-piperidino-6-methyl-7-anilinofluoran, 3-ethyl-tolylamino-6-methyl-7-anilinofluoran, 3-ethyl-tolylamino-6-methyl-7-phenetylfluoran or 3-diethylamino-7-(4-nitroanilino)fluoran, etc., (4) thiazine compounds such as benzoyl leuco Methylene Blue or p-nitrobenzoyl leuco Methylene Blue, etc., (5) spiro compounds such as 3-methyl-spiro-dinaphthopyran, 3-ethyl-spiro-dinaphthopyran, 3,3'-dichloro-spiro-dinaphthopyran, 3-benzyl-spirodinaphthopyran, 3-methylnaphtho-(3-methoxybenzo)spiropyran or 3-propyl-spiro-dibenzopyran, etc., and mixtures of them. They are selected on the basis of use and desired characteristics, e.g., color density, color hue or fastness of colored images. The trianylmethane compounds and xanthene compounds are preferred as a color former. The amount of the color former coated is preferably about 1 to 5 gr/m$^2$.

As the electron accepting compound (color developer) used in the heat-sensitive coating solution of the present invention, phenol derivatives and aromatic carboxylic acid derivatives are preferably used, and bisphenols are particularly preferred. The amount of the color developer coated is preferably about 1 to 5 gr/m$^2$.

Examples of phenol derivatives include p-octylphenol, p-tert-butylphenol, p-phenylphenol, 1,1-bis-(p-hydroxyphenyl)propane, 2,2-bis-(p-hydroxyphenyl)-propane, 1,1-bis-(p-hydroxyphenyl)pentane, 1,1-bis-(p-hydroxyphenyl)hexane, 2,2-bis-(p-hydroxyphenyl)hexane, 1,1-bis-(p-hydroxyphenyl)-2-ethylhexane and 2,2-bis-(4-hydroxy-3,5-dichlorophenyl)propane.

Examples of the aromatic carboxylic acid derivatives include p-hydroxybenzoic acid, ethyl p-hydroxybenzoate, butyl p-hydroxybenzoate, 3,5-di-tert-butylsalicylic acid, 3,5-di-α-methylbenzylsalicylic acid and polyvalent metal salts of the above described carboxylic acids.

Waxes and metal soaps are preferably added to the heat-sensitive coating solution in the present invention.

Examples of waxes include paraffin wax, carnauba wax, microcrystalline wax, polyethylene wax, higher aliphatic acid amides such as stearic acid amide or ethylenebisstearoamide and higher aliphatic acid esters, etc.

Examples of metal soaps include polyvalent metal salts of higher aliphatic acids, such as zinc stearate, aluminium stearate, calcium stearate or zinc oleate, etc.

These materilas are coated in the form of a dispersion in a binder. As the binder, water soluble substances are generally used. Useful binders include polyvinyl alcohol, hydroxyethyl cellulose, hydroxypropyl cellulose, ethylene-maleic acid anhydride copolymer, styrene-maleic acid anhydride copolymer, isobutylenemaleic acid anhydride copolymer, polyacrylic acid, starch derivatives, casein and gelatine, etc. Further, in order to give water resistance to the binder, it is possible to add a water proofing agent (gelatinizing agent or crosslinking agent) or a hydrophobic polymer emulsion, for example, a styrene-butadiene rubber latex or an acrylic resin emulsion, etc. to the binder.

Further, application of the heat-sensitive recording layer is carried out by methods used by persons skilled in the art. For example, it is possible to use air-knife coating, roll coating, blade coating, size press coating, curtain coating, bar coating, gravure coating, extrusion coating or hopper coating, etc., preferably air-knife coating, curtain coating and bar coating, by which one or more layers can be applied at the same time.

In the following, examples are shown, but the present invention is not limited to them.

EXAMPLE 1

20 g of 3-diethylamino-6-chloro-7-anilinofluoran was dispersed in 100 g of a 10% aqueous solution of polyvinyl alcohol (saponification value: 98% and degree of polymerization: 500) by treating in a 300 ml ball mill for 24 hours to obtain a dispersion (A).

Likewise, 20 g of benzyl p-hydroxybenzoate was dispersed in 100 g of a 10% aqueous solution of polyvinyl alcohol by treating in a 300 ml ball mill for 24 hours to obtain a dispersion (B).

Likewise, 20 g of 1,1,3-tris-(2-methyl-4-hydroxy-5-tert-butylphenyl)butane was dispersed in 100 g of a 10% aqueous solution of polyvinyl alcohol by treating in a 300 ml ball mill for 24 hours to obtain a dispersion (C).

The dispersions (A), (B) and (C) were blended in a ratio by weight of 3:10:5. Further, to 200 g of the resulting mixture solution, 50 g of a finely divided calcium carbonate powder was added and sufficiently dispersed to obtain a coating solution.

The resulting heat-sensitive coating solution was applied to a high-grade paper which was subjected to high frequency corona discharge treatment at a frequency of 10 KHz, an applied energy per unit width of 8.0 KVA/m and a treating rate of 110 m/min by an air-knife coater so as to result in a solid coating amount of 6 g/m$^2$, and dried to obtain a heat-sensitive recording paper.

When the entire surface of the resulting heat-sensitive recording paper was developed at a temperature of 120° C., a uniform colored face was obtained, wherein parts which were not coated were not observed.

Further, when it was typed at an energy of 50 mJ/mm$^2$, clear-cut recording images which were not thin could be obtained.

EXAMPLE 2

25 g of 3-diethylamino-6-chloro-7-ethoxyethylaminofluoran and 21 g of 3-diethylamino-7-o-chloroanilinofluoran were dispersed in 450 g of a 5% aqueous solution of polyvinyl alcohol (saponification vlaue: 98% and degree of polymerization: 500) by treating in a 500 ml ball mill for 24 hours to obtain a dispersion (A).

Then, 117 g of bisphenol A was dispersed in 600 g of a 5% aqueous solution of polyvinyl alcohol by treating in a 1000 ml ball mill for 24 hours to obtain a dispersion (B).

Further, 450 g of a kaolin and 4 g of sodium hexametaphosphate were dispersed in 600 g of water by treating in a 1000 ml ball mill for 24 hours to obtain a dispersion (C).

Then, 53 g of bisphenol A and 53 g of stearic acid amide were added to 450 g of 5% polyvinyl alcohol heated to 90° C. with stirring by a homomixer. After being stirred at 90° C. for 30 minutes, the mixture was cooled to 30° C. and dispersed by a 700 ml ball mill for 24 hours to obtain a dispersion (D).

The dispersions (A), (B), (C) and (D) were blended. Further, 550 g of a 20% aqueous solution of gum arabic, 260 g of a 20% dispersion of zinc stearate and 0.7 g of 2-ethylhexyl sulfosuccinic acid ester were added to the mixture to obtain a heat-sensitive coating solution.

The resulting heat-sensitive coating solution was applied to a high-grade paper which was subjected to high frequency corona discharge treatment at a frequency of 10 KHz, and applied energy per unit width of 12.5 KVA/m and a treating rate of 80 m/min by an air-knife coater so as to result in a solid coating amount of 6 g/m$^2$, and dried to obtain a heat-sensitive recording paper having an excellent coating surface wherein parts which were not coated were not observed.

When the whole surface of the resulting heat-sensitive recording paper was developed at a temperature of 120° C., a uniform colored face was obtained.

Further, when it was typed at an energy of 50 mJ/mm$^2$, clear-cut recording images which were not thin could be obtained.

COMPARATIVE EXAMPLE

A heat-sensitive recording paper was obtained by the same manner as in Example 2, except that a high-grade paper which was not subjected to corona discharge treatment was used as a base paper.

When the whole surface of the resulting heat-sensitive recording paper was developed at a temperature of 120° C., fine parts which were not coated appeared on the whole surface.

Further, when it was typed at an energy of 50 mJ/mm$^2$, the recording images became thin and some of them were difficult to read.

While the invention has been described in detail and with reference to specific embodiments thereof, it will be apparent to one skilled in the art that various changes and modifications can be made therein without departing from the spirit and scope thereof.

What is claimed is:

1. A process for producing a heat-sensitive recording paper which comprises pretreating a base paper by a high-frequency corona discharge and then applying an aqueous-type coating solution for forming a heat-sensitive recording layer to the base paper, wherein the high-frequency corona discharge treatment is carried out utilizing a discharge frequency in the range of 5 to 200 KHz and is carried out such that the product of the discharge electric current and the discharge voltage applied to a unit width is in the range of 0.5 KVA/m$^2$ to 50 KVA/m$^2$.

2. A process for producing a heat-sensitive recording paper as claimed in claim 1, wherein the high-frequency corona discharge treatment is carried out at a rate in the range of 30 m/min to 1,000 m/min.

3. A process for producing a heat-sensitive recording paper as claimed in claim 1, wherein the base paper is selected from the group of materials consisting of high-grade paper, middle-grade paper, regenerated paper, coat paper and synthetic paper.

* * * * *